US006261126B1

(12) United States Patent
Stirling

(10) Patent No.: US 6,261,126 B1
(45) **Date of Patent: *Jul. 17, 2001**

(54) COAXIAL CABLE CONNECTOR WITH RETRACTABLE BUSHING THAT GRIPS CABLE AND SEALS TO ROTATABLE NUT

(75) Inventor: Albert Stirling, Markham (CA)

(73) Assignee: Cabletel Communications Corp., Markham (CA)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/030,817

(22) Filed: Feb. 26, 1998

(51) Int. Cl.[7] ..... H01R 9/05
(52) U.S. Cl. ..... 439/583
(58) Field of Search ..... 439/578, 583, 439/584, 133, 587, 589, 320

(56) References Cited

U.S. PATENT DOCUMENTS

| | | | | |
|---|---|---|---|---|
| 4,834,675 | | 5/1989 | Samchisen | 439/578 |
| 4,902,246 | | 2/1990 | Samchisen | 439/578 |
| 4,952,174 | * | 8/1990 | Sucht et al. | 439/584 |
| 5,007,861 | | 4/1991 | Stirling | 439/578 |
| 5,011,432 | | 4/1991 | Sucht et al. | 439/584 |
| 5,470,257 | * | 11/1995 | Szegda | 439/578 |
| 5,667,405 | * | 9/1997 | Holliday | 439/578 X |

FOREIGN PATENT DOCUMENTS

| | | |
|---|---|---|
| 0 459 825 | 12/1991 | (EP) . |
| 1087228 | 10/1967 | (GB) . |
| WO 90/15454 | 12/1990 | (WO) . |

* cited by examiner

*Primary Examiner*—Neil Abrams
*Assistant Examiner*—J. F. Duverne
(74) *Attorney, Agent, or Firm*—Bereskin & Parr

(57) ABSTRACT

A connector is provided for interconnecting a coaxial cable to an electrical device. The connector has an internal body with a rotatable nut and an external body with a rotatable nut which are assembled together, and which can be activated to clamp upon and seal to an inserted coaxial cable without disassembling the external body from the internal body. The external body is axially moveable and when activated to clamp upon the inserted coaxial cable, also engages the sealing ring positioned around the internal body to form a seal with the rotatable nut.

7 Claims, 3 Drawing Sheets

COAXIAL CABLE CONNECTOR WITH RETRACTABLE BUSHING THAT GRIPS CABLE AND SEALS TO ROTATABLE NUT

FIELD OF THE INVENTION

This invention relates generally to a connector for coaxial cable, such as the type used for cable TV transmission.

BACKGROUND OF THE INVENTION

Coaxial cable connectors that require crimping are associated with certain disadvantages. Crimping tools tend to wear out with repeated use, and crimping does not provide a satisfactory seal. A number of crimpless connectors have been developed which attempt to overcome these problems.

One type of crimpless connector receives a compression sleeve, which is first broken away from a plastic ring mounted on the connector, and then slid over the cable and finally inserted into the annular cavity between the inner wall of the connector and the jacket of the cable. A tool is used to push the compression sleeve fully into the connector with a snap engagement.

A problem with this connector is that it can be awkward to break the compression sleeve away from the connector and then thread it onto the cable, particularly when used in field installations where there may be adverse weather conditions. The compression sleeve can as well be inadvertently threaded onto the cable backwards, and it can also be dropped and lost.

An alternative crimpless connector has more recently been provided, which permits the cable to be secured to it simply by pushing the cable into the connector and subsequently pulling it back. The body of this "push-pull" connector has a bushing mounted within it near the cable receiving end having a diameter to closely receive the cable. The body of the connector also has within it an annular mandril having a bore to receive the stripped core of the cable, and having a sleeve adapted to engage the cable beneath the jacket by pushing the cable and the mandril together. This stretches the jacket of the cable to a diameter greater than the internal diameter of the bushing.

The mandril is moveable from a position in which the sleeve is surrounded by the bushing in which the sleeve may be engaged to the cable, to a position in which the sleeve is at least partially within the bushing in which the jacket is frictionally engaged by the bushing by pulling the cable away from the connector after it has been pushed onto the mandril sleeve.

While the push-pull cable connector has many advantages, it does not lend itself to all applications. In some publicly accessible installations, for example, it is the usual practice to cover the threaded posts to which the cables are connected by a security ring, making the threaded portion of an installed cable connector inaccessible to finger manipulation or common wrenches or pliers. Unauthorized removal of the cable is thereby discouraged as a special tool is needed to fit within the security ring.

Due to the close tolerances of the standard security ring, the dimensional limitations of the push-pull connector present a significant obstacle. The internal bushing and mandril of the push-pull connector require a larger body diameter than can be accommodated in the standard sized security ring. While a larger security ring could be substituted, doing so would present additional costs.

It has also been found that the push-pull connector can be awkward to use with coaxial cable having multiple layers of braided shielding. Because of the limited travel of the mandril and bushing, the inserted cable must be trimmed to expose only a short distance of braided shielding. Folding back one layer of braided shielding presents little difficulty. However, manipulating multiple layers of braided shielding that are as short as required can be awkward. While a push-pull connector could be made with a longer travel for the mandril and bushing, thus allowing a longer trimmed section for the cable, this would require a longer overall connector length which would increase material costs.

BRIEF SUMMARY OF THE INVENTION

The purpose of the present invention is to obviate or mitigate the disadvantages of known connectors for coaxial cable.

In accordance with the invention, a connector is provided for use with a coaxial cable of the type having a central conductor, a dielectric insulator with a foil cover encasing the central conductor, at least one braided shield surrounding the foil covered dielectric insulator, and a plastic jacket covering the braided shield.

The connector comprises an internal body, means for interconnecting the connector to an electrical device, and an external body, assembled together so as to resist subsequent disassembly. The connector is adapted to receive a coaxial cable and to tightly hold the cable and form a seal with it by moving the external body relative to the internal body without disassembling the external body from the internal body.

The internal body is preferably in the form of a mandril that has a bore of a diameter to receive the dielectric insulator of the coaxial cable. The mandril has a sleeve with an end adapted to engage the cable beneath the braided shield and jacket.

The interconnecting means comprises threaded nut means which is rotatably mounted to the internal body at the end thereof remote from the sleeve end adapted to engage the cable.

The external body is preferably in the form of a gripping bushing that is mounted to the connector partially surrounding the mandril and concentric to it. At its free end it has a bore of a diameter to receive the jacket of the cable. The bushing is moveable from a first position in which the bore of the bushing and the sleeve of the mandril define an annular gap to receive the braided shield and the jacket of the cable, to a second position in which the annular gap between the bushing and the sleeve of the mandril is reduced, thereby squeezing the braided shield and the jacket of the cable.

Preferably the nut means is rotatably mounted to the mandril and retained thereto by a flange on the mandril. More preferably, the sleeve of the mandril is tapered and barbed.

Advantageously the gripping bushing is assembled with the mandril by close frictional contact and is moveable slidingly from its first position to its second position by means of a squeezing tool.

The connector also includes an O-ring retained upon the internal body close to the nut means, and the external body slides over the O-ring when it is moved into its second position.

It has been found that the connector of the present invention provides an effective solution to the problems presented by known prior art coaxial cables, as described above.

The connector of the present invention is preassembled. No separate pieces are involved that must be threaded onto the cable, and which can be misoriented or lost. The dimensional tolerances of the connector of the present invention, moreover, enable it to be used with the standard sized security ring. In addition, the connector of the present invention easily accepts coaxial cable having multiple layers of braided shielding with longer trimmed sections that facilitate folding of the braided shielding back over the cable jacket.

BRIEF DESCRIPTION OF THE DRAWINGS

In order that the invention may be more clearly understood, reference will be made to the accompanying drawings which illustrate a preferred embodiment of the coaxial cable connector of the present invention, and in which.

DESCRIPTION OF THE PREFERRED EMBODIMENT

Figure 1:
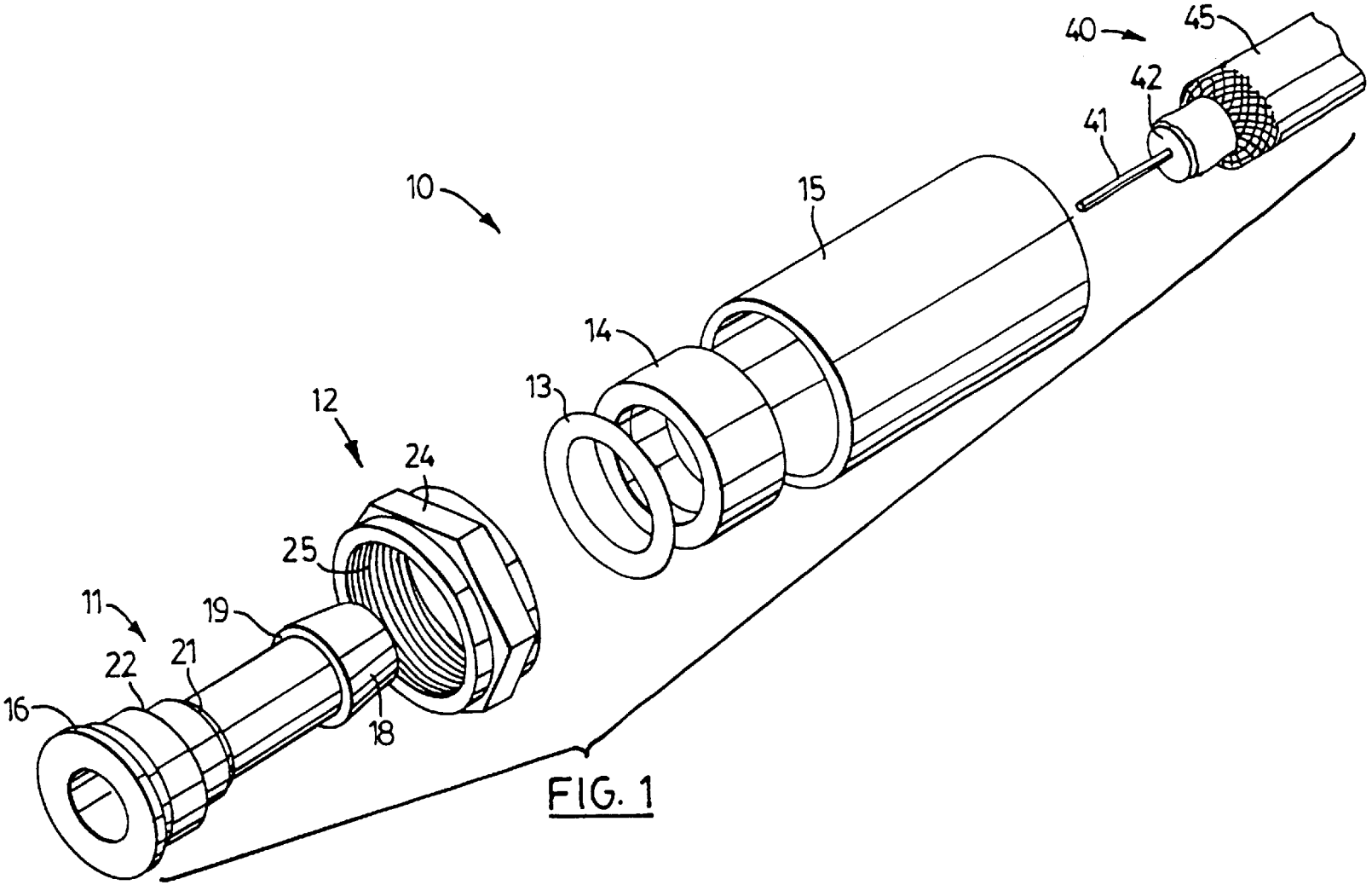
FIG. 1 is an exploded perspective view of a cable connector of the present invention, shown with a coaxial cable.

In the drawings, the coaxial cable connector is denoted generally by reference number 10. The cable is denoted by reference number 40 and is of a standard configuration comprising a central conductor 41, a dielectric insulator 42 with a foil cover 43, a braided shield 44 and a plastic jacket 45.

The connector 10 comprises a mandril 11, a nut member 12, an O-ring 13, a retainer 14 and a bushing 15. The O-ring 13 is made of a compressible, elastomeric material, such as rubber or plastic, and the mandril 11, nut member 12, retainer 14, and bushing 15 are all made of a rigid material, preferably metallic, such as brass.

The mandril 11 is generally cylindrical having an enlarged base w with a sleeve 17 extending therefrom. A flange 16 projects outwardly from the end of the enlarged base of the mandril 11. The sleeve 17 has a tapered end 18 with a barb 19. A bore 20 extends through the mandril 11 having a diameter to receiving the dielectric 42 and its foil cover 43 and the conductor 41.

The nut member 12 is mounted rotatably to the mandril 11. The nut member 12 has a collar 23 that engages the flange 16 of the mandril 11 to permit free rotation between the nut member 12 and the mandril. The nut member 12 is provided with internal threads 25 and hexagonal flats 24.

The retainer 14 is generally cylindrical and is fixedly mounted to the mandril 11. The retainer 14 has a base 26 with a wall 27 extending therefrom. The base 26 has an internal diameter that allows it to be mounted to the enlarged base of the mandril 11 and held securely by frictional engagement. A square shoulder 22 on the enlarged base of the mandril 11 provides a seat for the base 26 of the retainer 14.

The collar 23 of the nut member 12 and the enlarged base of the mandril 11 and the base 26 of the retainer 14 together define an annular groove 28 in which sits the O-ring 13. The O-ring 13 is of a size and dimension to seat in the annular groove 28, and to extend slightly beyond the retainer 14.

The bushing 15 is also cylindrical and has a mouth 31 at one end dimensioned to receive the coaxial cable 40. The other end of the bushing 15 is adapted to be mounted to the retainer 14 with a close fitting but slidable engagement.

Figure 5:
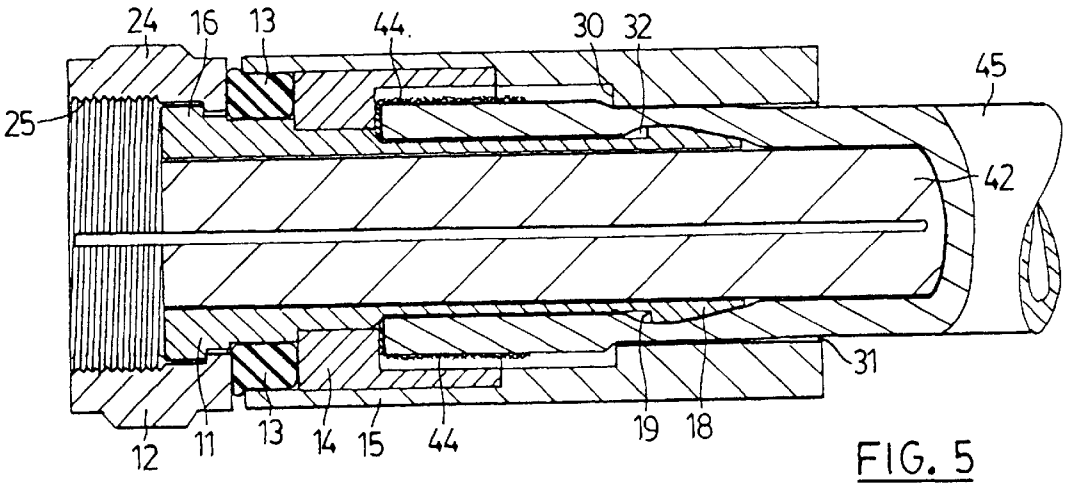
FIG. 5 is a cross-sectional side view of the same connector as in FIG. 4, with the outer bushing of the connector having been moved from its original position, in which the connector can receive the coaxial cable, to its final position, in which the connector tightly holds the inserted coaxial cable and forms a seal therewith.

The bushing 15 has a stepped internal surface. A first step 29 reduces the internal diameter of the bushing from a dimension corresponding to the outside diameter of the retainer 14 to a dimension corresponding to the inside diameter of the wall 27 of the retainer 14. The first step 29 of the bushing 15 seats against the end of the wall 27 of the retainer 14 when the bushing 15 has been activated to slide into its clamping position, as shown in FIG. 5. A second step 30 on the internal surface of the bushing 15 defines the depth of the mouth 31.

Figure 2:
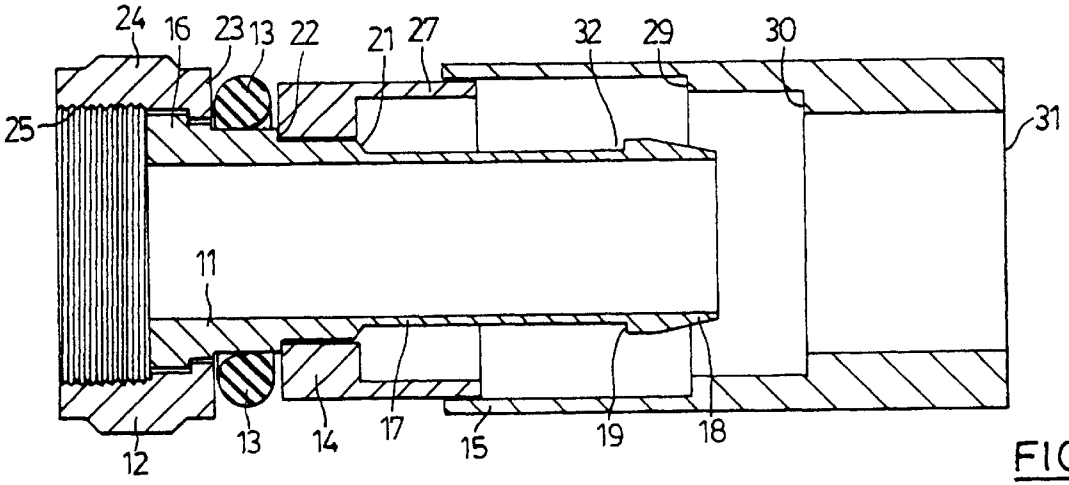
FIG. 2 is a cross-sectional side view of the connector of FIG. 1.

The connector 10 is assembled by first mounting the nut member 12 to the mandril 11, then mounting the O-ring 13, and subsequently mounting the retainer 14, which prevents the O-ring 13 and the nut member 12 from subsequent removal from the mandril 11. Finally, the bushing 15 is mounted to the retainer 14 as shown best in FIG. 2.

In mounting the connector 10 to the coaxial cable 40, the cable is first prepared by exposing a length of the central conductor 41, and also stripping a further length of the dielectric 42 and its foil-cover 43. The braided shield 44 is cut slightly longer than the jacket 45 and is folded back over the edge thereof, as shown in FIG. 1.

Figure 3:
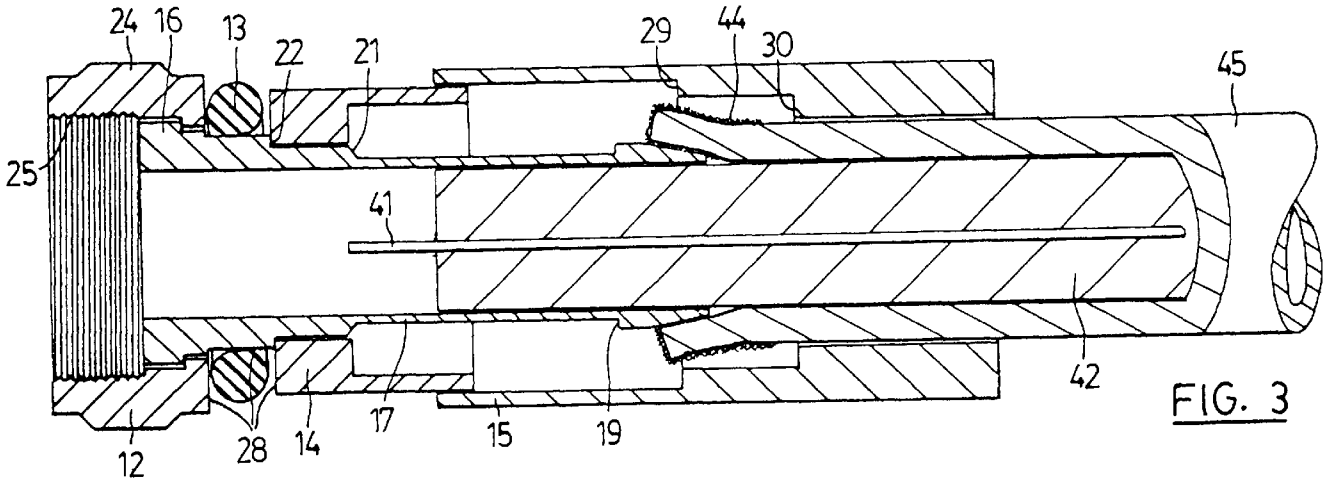
FIG. 3 is a cross-sectional side view of the same connector as shown in FIG. 2, with a coaxial cable having been inserted therein.
Figure 4:
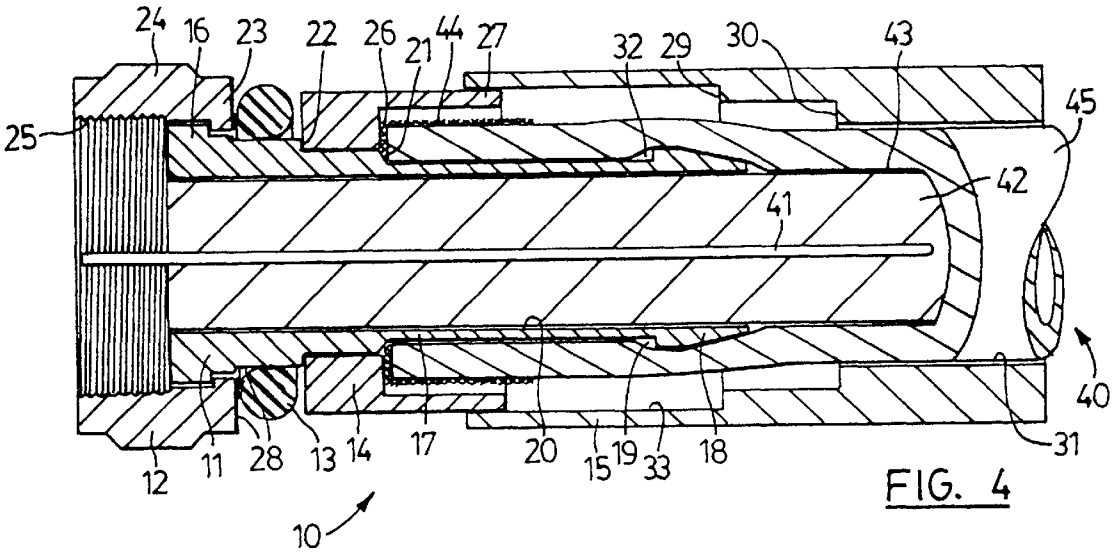
FIG. 4 is a cross-sectional side view of the same connector as in FIG. 3, with the coaxial cable having been inserted further therein.

As shown in FIGS. 3 and 4, the cable 40 is inserted into the connector 10 such that the conductor 41, the dielectric 42 and the foil 43 are received within the bore 20 of the mandril 11. The tapered end 18 of the mandril slides beneath the braided shield 44 and the jacket 45 of the cable 40. The barb 19 on the sleeve 17 of the mandril 11 resists subsequent removal of the cable 40 from the mandril 11.

The trimmed end of the jacket 45 of the cable 40 and the folded back portion of the braided shield 44 encounter a flared shoulder 21 on the sleeve 17 of the mandril 11. A cavity 33 between the internal surfaces of the bushing 15 and retainer 14 and the external surface of the sleeve 17 accommodates the jacket 45 and the folded back portion of the braided shield 44 of the cable 40.

When the cable 40 has been fully inserted into the connector 10 such that the conductor 41 extends into the nut member 12, the connector is placed in a levered squeezing tool (not shown) by means of which the bushing 15 can be forced to slide over the retainer 14 and the O-ring 13.

As the bushing is moved, the gap 32 between the bushing 15 and the tapered end 18 of the mandril 11 is reduced, as shown in FIG. 5. The second step 30 of the bushing 15 impinges upon the cable 40, squeezing the braided shield 44 and jacket 45 between the mouth 31 of the bushing 15 and the tapered end 18 of the mandril 11 such that when the bushing 15 is collapsed fully onto the retainer 14, with the first step 29 seated upon the end of the wall 27, the cable 40 is clamped tightly by the connector 10 with a moisture seal formed between the jacket 45 of the cable and the mouth 31 of the bushing 15.

In addition, the end of the bushing 15 that is mounted to the retainer 14 contacts and compresses the O-ring 13 within the annular groove 28 to provide a more secure seal between the nut member 12 and the mandril 11.

It will of course be appreciated that many variations are possible within the broad scope of the invention. For example, the retainer and mandril could be an integral body. The configuration of the connector and its component parts could also be modified. Means other than the threaded nut member could be substituted for engagement of the connector to an electronic device. The O-ring could be replaced with a different type of sealing means between the mandril and the nut member, and the placement of such bring or other sealing means could as well be altered.

I claim:

1. A connector for interconnecting to an electrical device, a coaxial cable of the type having a central conductor, a foil-covered dielectric insulator encasing the central conductor, at least one braided shield around the dielectric insulator, and a jacket covering the at least one braided shield, said connector comprising:

an internal body having a bore of a diameter to receive the dielectric insulator of such a coaxial cable, and having a sleeve with an end adapted to engage the cable beneath the at least one braided shield and the jacket;

threaded nut means rotatably mounted to said internal body, remote from said sleeve end thereof, for interconnecting said connector to such an electrical device;

sealing ring means disposed around said internal body contiguous to said rotatable nut means;

an external body surrounding a portion of said internal body, having at a free end thereof a mouth of a diameter to receive the cable, said mouth being generally concentric with said bore of said internal body, said external body being assembled with said internal body and said rotatable nut means so as to resist subsequent disassembly, and said external body being moveable without disassembly from said internal body, form a first position in which said external body is remote form said rotatable nut means and said contiguous sealing ring means and in which said external body and said sleeve of said internal body define an annular gap to receive the at least one braided shield and the jacket of the cable, to a second position in which said external body contacts said sealing ring means and in which said annular gap between said external body and said sleeve of said internal body is reduced, such that said connector can be attached to the cable by inserting the cable into said mouth of said external body while said external body is in said first position, and pushing the dielectric insulator of the cable into the bore of the internal body with said sleeve end thereof engaging beneath the at least one braided shield and the jacket of the cable, and subsequently moving said external body to said second position, thereby sealing said external body to said rotatable nut means by compressing said sealing ring means therebetween, and thereby also squeezing the at least one braided shield and the jacket of the cable between said external body and said sleeve of said internal body so as to tightly hold the cable within said connector and to form a seal between said mouth of said external body and the jacket of the cable.

2. The connector of claim 1, wherein said internal body has a flange remote from said sleeve end which retains said rotatable nut means.

3. The connector of claim 2, wherein said external body is assembled with said connector by close frictional contact, and is moveable slidingly from said first position to said second position by means of a squeezing tool.

4. A connector for use with a coaxial cable of the type having a central conductor, a foil-covered dielectric insulator encasing the central conductor, at least one braided shield around the dielectric insulator, and a jacket covering the at least one braided shield, said connector comprising:

a mandril with a bore of a diameter to closely receive the dielectric insulator of such coaxial cable, having at a first end thereof a sleeve adapted to engage the cable beneath the at least one braided shield and the jacket;

threaded nut means rotatably engaged to said mandril at the second end thereof, remote from said sleeve;

sealing ring means disposed around said mandril contiguous to said rotatable nut means;

a bushing disposed around a portion of said mandril and concentric thereto, having at its free end a mouth of a diameter to receive the cable, and being moveable from a first position in which said bushing is remote from said rotatable nut means and said contiguous sealing ring means, and in which said bushing and said sleeve of said mandril defined an annular gap to receive the at least one braided shield and the jacket of the cable, to a second position in which said bushing contacts said sealing ring means and compresses it upon said rotatable nut means and thereby seals said bushing to said rotatable nut means, and in which said annular gap between said sleeve of said mandril and said bushing is reduced so as to squeeze the at least one braided shield and the jacket of the cable and thereby tightly hold the cable and seal it to said bushing.

5. The connector of claim 4, wherein said mandril has a flange at said second end which retains said rotatable nut member.

6. The connector of claim 5, wherein said sleeve is tapered and barbed.

7. The connector of claim 6, wherein said bushing is engaged to said connector by close frictional contact, and is moveable slidingly from said first position to said second position by means of a squeezing tool.

* * * * *